US006001149A

United States Patent [19]

Hauner et al.

[11] Patent Number: 6,001,149

[45] Date of Patent: Dec. 14, 1999

[54] PROCESS FOR PRODUCING A SHAPED ARTICLE FROM CONTACT MATERIAL BASED ON SILVER, CONTACT MATERIAL AND SHAPED ARTICLE

[75] Inventors: Franz Hauner, Röttenbach; Günter Tiefel, Fürth, both of Germany

[73] Assignee: Siemens Aktiengesellschaft, Munich, Germany

[21] Appl. No.: 09/123,078

[22] Filed: Jul. 27, 1998

Related U.S. Application Data

[63] Continuation of application No. PCT/DE97/00042, Jan. 13, 1997.

[30] Foreign Application Priority Data

Jan. 26, 1996 [DE] Germany ..... 196 02 812.4

[51] Int. Cl.[6] ..... C22C 5/06; B22F 3/00

[52] U.S. Cl. ..... 75/247; 252/513; 252/514; 419/23; 419/58

[58] Field of Search ..... 75/247, 232; 419/31, 419/26, 21, 23, 58; 252/513, 514

[56] References Cited

U.S. PATENT DOCUMENTS

| | | | |
|---|---|---|---|
| 2,145,690 | 1/1939 | Hensel . | |
| 2,664,618 | 1/1954 | Kleis . | |
| 3,135,601 | 6/1964 | Peiffer . | |
| 3,505,065 | 4/1970 | Gwyn . | |
| 4,361,033 | 11/1982 | Kim et al. . | |
| 5,286,441 | 2/1994 | Shibata | 419/21 |
| 5,591,926 | 1/1997 | Inada et al. | 75/247 |
| 5,728,194 | 3/1998 | Weisse et al. | 75/235 |

FOREIGN PATENT DOCUMENTS

| | | |
|---|---|---|
| 0 586 411 B1 | 3/1994 | European Pat. Off. . |
| 43 31 913 A1 | 3/1995 | Germany . |
| 1 524 074 | 9/1978 | United Kingdom . |
| 1 536 847 | 12/1978 | United Kingdom . |

OTHER PUBLICATIONS

International Publication No. WO 92/22079 (Hauner et al.), dated Dec. 10, 1992.

International Publication No. WO 95/08833 (Hauner), dated Mar. 30, 1995.

"Measuring of the welding force, the melting loss and the contact resistance of contact materials for power–engineering" (Schreiner et al.), J. of Material Technology No. 7, pp. 381–389, 1976.

*Primary Examiner*—Ngoclan Mai

*Attorney, Agent, or Firm*—Herbert L. Lerner; Laurence A. Greenberg

[57] ABSTRACT

A contact material, a shaped article or contact piece and a process for producing a shaped article from a contact material based on silver, include forming a powder mixture from silver and a metal oxide, and metallurgically processing the powder to form the shaped article with the metal oxide being reduced to metal. Since metal oxide powders are obtainable with a very much smaller particle size than metal powders, it is possible to obtain a contact material with a mean particle size of the metal incorporated as an active component of less than 1 $\mu$m. Such a contact material has particularly favorable switching properties as a result of the fine particle size.

18 Claims, 2 Drawing Sheets

20 μm

20 μm

20 μm

20 μm

PROCESS FOR PRODUCING A SHAPED ARTICLE FROM CONTACT MATERIAL BASED ON SILVER, CONTACT MATERIAL AND SHAPED ARTICLE

CROSS-REFERENCE TO RELATED APPLICATION

This application is a continuation of International Application No. PCT/DE97/00042, filed on Jan. 13, 1997, which designated the United States.

BACKGROUND OF THE INVENTION

1. Field of the Invention

The invention relates to a process for producing a shaped article from a contact material based on silver. The invention furthermore relates to a contact material of that type and to a shaped article or contact piece made of such a contact material.

Contact materials based on silver, which contain particular active components, have long been found useful for a contact piece in power engineering low-voltage switching equipment, for example in a circuit-breaker or in a contactor relay. Both metals and metal oxides are known as active components which favorably affect the switching properties of the contact material. Examples of metallic contact materials based on silver are silver-nickel (AgNi) and silver-iron (AgFe). An example of oxide contact materials which may be mentioned is silver iron oxide ($AgFe_2O_3$).

Although oxide contact materials are less inclined to welding than metallic contact materials, the latter have a greater lifetime, in particular at low currents. In order to measure particular properties of a contact material, use is conventionally made of a test switch into which a contact piece made of the contact material is respectively fitted. Such a test switch is described in an article in Z.f. Werkstofftechnik/J. of Materials Technology 7, (1976), pages 381 to 389.

In particular, silver-nickel contact materials have good switching properties. However, there is the disadvantage that nickel dust which is formed during production or during operation by abrasion, and nickel oxide which is formed as a switching product, may have a detrimental effect on the human body.

European Patent 0 586 411 B1, corresponding to U.S. Pat. No. 5,422,065, discloses a contact material, based on silver, which contains the metals iron and rhenium as active components in proportions by mass of between 1% and 50% and between 0.01% and 5%, respectively. In that regard it has been found that rhenium improves the properties of a contact material of that type even in proportions by mass of less than 1%. That contact material is distinguished by a low degree of contact heating with a stable thermal behavior, a tolerable susceptibility to welding and a long lifetime in regard to predetermined switching current densities.

According to European Patent 0 586 411 B1, corresponding to U.S. Pat. No. 5,422,065, the silver-iron-rhenium contact material is produced by mixing silver and iron-rhenium alloy powder or by mixing separate silver, iron and rhenium powders. The powder mixture is then processed using molding presses or extruders and sintering to form shaped articles or to form semi-finished products. The structure of the material of that type, that is to say the size and the distribution of the active components in the silver matrix, is predetermined by the particle size of the commercially available metal powders or alloy powders. Using coarse metal powders leads to a coarse-grained structure, and using fine-grained metal powders leads to a fine-grained structure. The finest iron powders produced in industrial quantities have a mean particle size of about 5 μm. Iron-rhenium powders are produced by atomizing a corresponding melt and likewise have a mean particle size of about 5 μm or more.

There are essentially two known different powder metallurgy processes for producing a shaped article from the contact material. In the molding technique, the powder mixture is compressed in molding presses to form a molded part which is processed by sintering and, where appropriate, further pressing to form a finished shaped article. In order to produce a shaped article in the form of a contact piece, the molded part may additionally be pressed with a layer of pure silver for reliable connection of the contact piece to the support by silver soldering.

In a shaped article produced according to the molding technique, the active components added in powder form with a uniform particle size are distributed irregularly through the silver matrix. The structure of the shaped article is substantially isotronic.

In the extrusion technique, the powder mixture is firstly pressed and/or sintered to form a porous pressed part or billet. The pressed part or billet is extruded, where appropriate with a layer of pure silver (see above) to form a rod from which the shaped articles are detached and optionally subjected to subsequent treatment.

In a shaped article produced according to the extrusion technique, the powder grains of the silver and, where appropriate, of the active components, are deformed or aligned in the extrusion direction, as a result of which an anisotropic or, rather, linear structure is formed.

The electrical switching properties of the contact material, for example erosion, contact resistance and welding force, are substantially determined by its structure.

International Publication Number WO 95/08833, corresponding to U.S. Pat. No. 5,628,448, describes a method for connecting a contact piece made of a silver-metal oxide material to a holder by silver soldering or welding. In that case, the metal oxide of the contact material is at least in part reduced to metal in the surface region of the contact piece. No resulting structural change which favorably affects the switching properties of the contact piece or of the contact material is achieved. The described method is suitable merely for producing thin, weldable and solderable layers to a few hundred μm.

SUMMARY OF THE INVENTION

It is accordingly an object of the invention to provide a process for producing a shaped article from a contact material based on silver, a contact material and a shaped article or contact piece, which overcome the hereinaforementioned disadvantages of the heretofore-known processes, materials and products of this general type, in which the contact material has better switching properties than the prior art and in which the shaped article or contact piece is particularly suitable for switching equipment in power engineering, by virtue of improved switching properties.

With the foregoing and other objects in view there is provided, in accordance with the invention, a process for producing a shaped article from a contact material based on silver, which comprises forming a powder mixture from silver and a metal oxide; and processing the powder mixture by powder metallurgy to form a shaped article with the metal oxide reduced to metal.

The invention in this regard is based on the discovery that a contact material with a fine structure has a better switching behavior than a contact material with a coarse structure. The set of properties of a contact material can be improved considerably by reducing the mean particle size of the active components in the silver matrix.

Extensive measurements lead to the expectation that the switching properties of a contact material based on silver, or the switching properties of the shaped article made of the contact material, are particularly favorable if the mean particle size of the active components is less than 1 $\mu$m.

However, a contact material of this type cannot be produced with known powder metallurgy production processes when employing commercially available metal powders having a mean particle size which is in the range of a few $\mu$m.

However, since metal oxide powders are available with particle sizes substantially smaller than 1 $\mu$m, it is possible to obtain a contact material in which the mean particle size of the metallic active components is in the nanometer range, by using metal oxide powder instead of metal powder and subsequently reducing the metal oxide. Furthermore, when using metal oxide powders, it is possible to work under less stringent transport and processing regulations since many metal powders ignite spontaneously, in contrast to metal oxide powders. All of this allows the production costs to be reduced.

In accordance with another mode of the invention, the reduction of the metal oxide takes place in the powder mixture since the increasing compaction of the powder mixture in subsequent process steps makes complete reduction of the metal oxide more difficult.

In accordance with a further mode of the invention, the reduction of the metal oxide takes place in a blank of the shaped article which still has sufficiently high porosity or gas permeability. A blank of this type is, for example, the billet provided by using the extrusion technique, which is subsequently pressed to form a rod. Likewise, a blank of this type may also be an intermediate product for a molded part, produced by using the molding technique, before the molded part is produced by repressing and sintering it.

In accordance with an added mode of the invention, the reduction of the metal oxide is achieved by heat treatment in a reducing atmosphere.

In accordance with an additional mode of the invention, the heat treatment is carried out in a temperature range of 500° C. below the melting point of silver, that is to say, taking into account the admixed active component, at a temperature of between 500° C. and 1000° C., preferably at 700° C. In this case, the reducing atmosphere may simultaneously be employed as a shield gas for sintering which may possibly be required. During production of the contact material, the sintering and reduction can therefore take place in a single process step.

In accordance with yet another mode of the invention, hydrogen gas ($H_2$), which is also conventionally used for sintering, is used as the reducing atmosphere.

The active components added in powder form can be conglomerated by virtue of the sintering and pressing processes required in powder metallurgy production processes. This is particularly so if the active component is added in the form of a powder of a metal oxide with very small particle sizes.

In accordance with yet a further mode of the invention, those particle sizes of the active component which are favorable for the switching properties can be achieved in the contact material if powder with a particle size of less than 1 $\mu$m preferably 100 to 500 nm, is used as the metal oxide. In accordance with yet an added mode of the invention, the produced contact material or the shaped article made of the contact material has advantageous switching properties if a further metal or a further metal oxide is mixed with the powder mixture. As described, the further metal oxide is reduced to a further metal in this case. It is, however, also conceivable to add the further metal oxide only after the powder mixture has been reduced. In this case, the contact material which has been produced has an oxide active component.

In accordance with yet an additional mode of the invention, silver (Ag), iron oxide ($Fe_2O_3/Fe_3O_4$,) and rhenium (Re); or silver (Ag), rhenium oxide (ReO) and iron (Fe); or silver (Ag), rhenium oxide (ReO) and iron oxide ($Fe_2O_3$,/$Fe_3O_4$,), are mixed with the powder mixture.

With the objects of the invention in view, there is also provided a contact material based on silver, comprising at least one further metallic component having a mean particle size less than 1 $\mu$m, preferably between 100 and 500 nm.

In addition to very good switching properties, a contact material of this type has, in particular, very little susceptibility to welding and a long lifetime.

In accordance with another feature of the invention, the contact material has favorable switching properties if iron (Fe) and/or rhenium (Re) are provided as metallic active components.

In accordance with a further feature of the invention, the iron (Fe) is present in a proportion by mass of between 1% and 50% and the rhenium (Re) is present in a proportion by mass of between 0.01% and 5%.

With the objects of the invention in view, there is additionally provided a shaped article made of the contact material described above.

In accordance with a concomitant feature of the invention, the shaped article is in the form of a contact piece. In this case, the contact piece may additionally be provided with a layer of pure silver for reliable connection of the contact piece to a support by silver soldering. A contact piece of this type is suitable for use in power engineering switching equipment, in particular for a low-voltage switch.

Other features which are considered as characteristic for the invention are set forth in the appended claims.

Although the invention is illustrated and described herein as embodied in a process for producing a shaped article from a contact material based on silver, a contact material and a shaped article or contact piece, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

A silver-iron-rhenium material is produced as an illustrative embodiment of the invention. To this end, silver powder Ag is mixed thoroughly with rhenium powder Re (particle size approximately 5 $\mu$m) and with iron oxide powder $Fe_2O_3$,/$Fe_3O_4$, (particle size less than 10 nm). This powder mixture is processed further to form a blank or billet which is stored at a temperature of 700° C. in an $H_2$-atmosphere to reduce the iron oxide to iron. The further processing to form a contact piece, after the extrusion technique described, takes place under known conditions.

The composition of the powder mixture is such that the sum of the proportions by mass of the active components iron (Fe) and rhenium (Re) is 8.8% in the finished material, and the ratio of iron to rhenium is selected as 19/1. The material will be referred to below as Ag (FeRe 95/5) 8.8, specifying the ratio 95/5 which relates to the mixing ratio of iron powder and rhenium powder associated with the fabrication technique.

Figure 1:
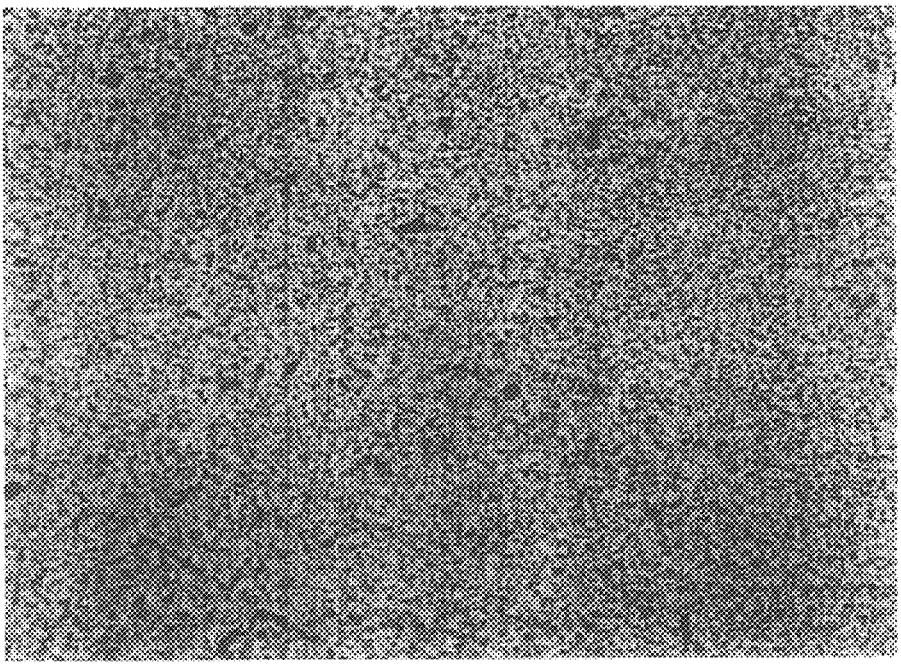
FIG. 1 is an illustration of a structure, perpendicularly to an extrusion direction, of an Ag (FeRe 95/5) 8.8 material produced according to the invention and using an extrusion technique.
Figure 2:
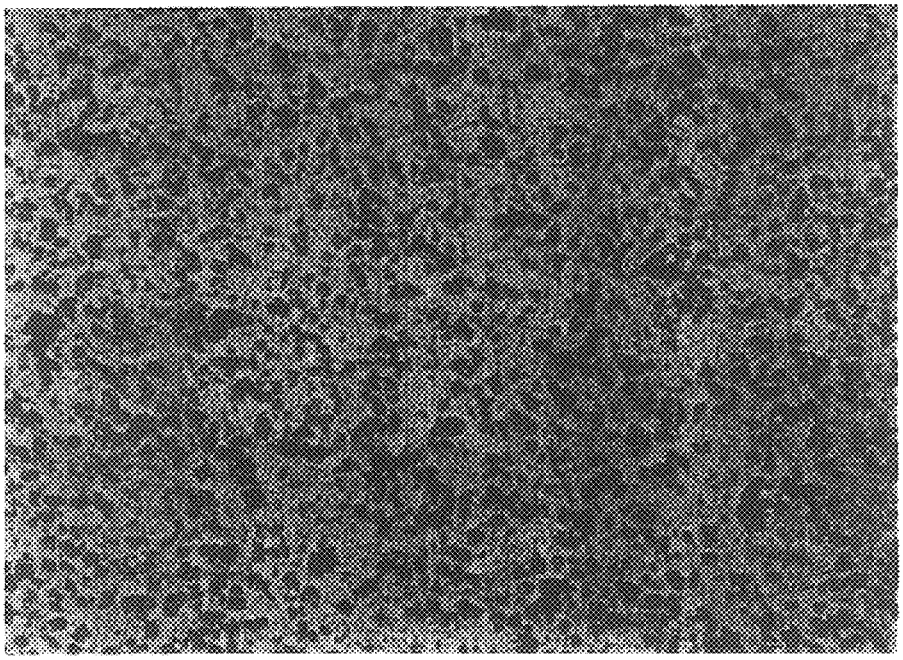
FIG. 2 is an illustration of a structure, perpendicularly to the extrusion direction, of an Ag (FeRe 95/5) 8.8 material produced conventionally using the extrusion technique.
Figure 3:
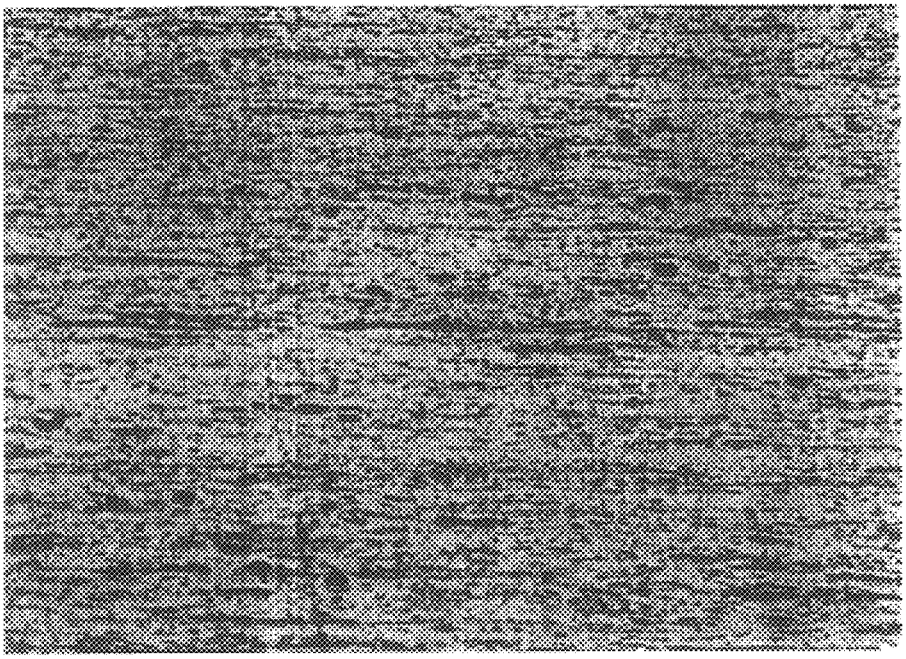
FIG. 3 is an illustration of a structure, parallel to the extrusion direction, of an Ag (FeRe 95/5) 8.8 material produced according to the invention using the extrusion technique.
Figure 4:
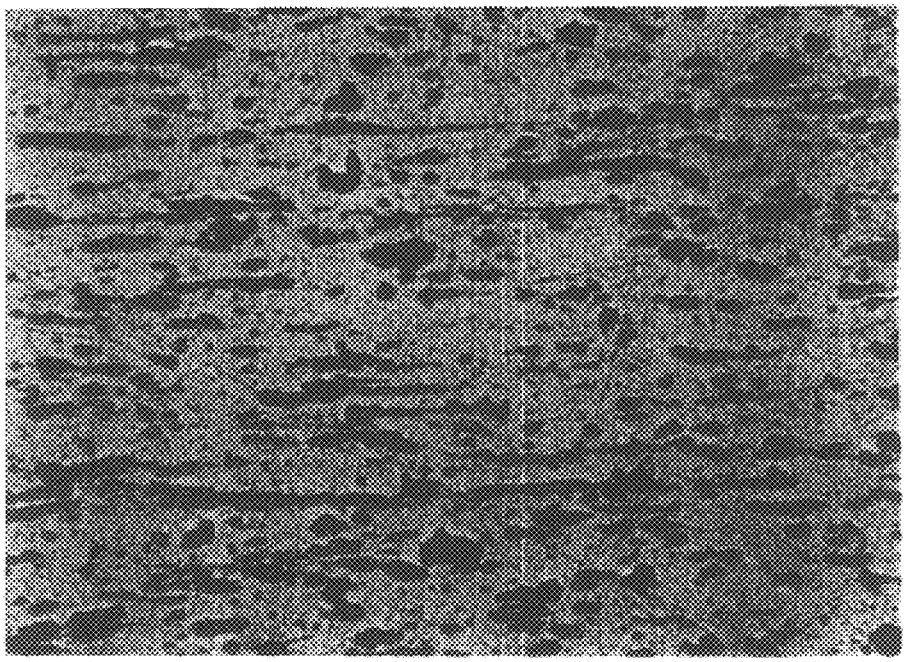
FIG. 4 is an illustration of a structure, parallel to the extrusion direction, of an Ag (FeRe 95/5) 8.8 material produced conventionally using the extrusion technique.

Referring now to the figures of the drawings in detail and first, particularly, to FIGS. 1 and 3 thereof, there are seen fine structures of an Ag (FeRe 95/5) 8.8 material produced in this way, that are respectively perpendicular and parallel to an extrusion direction. The mean particle size of the rhenium particles and iron particles in the silver matrix (measured perpendicularly to the extrusion direction as seen in FIG. 1) is in a range considerably below 1 $\mu$m. A comparison with a conventionally produced Ag (FeRe 95/5) 8.8 material having a structure perpendicularly to the extrusion direction as is represented in FIG. 2, shows a size difference of the active components embedded in the silver matrix that is significant. This can also be seen in FIGS. 3 and 4 which show the structure of an Ag (FeRe 95/5) 8.8 material respectively produced according to the invention and conventionally, parallel to the extrusion direction.

The welding force of the material was tested as a parameter which is indicative of the switching behavior of the material, according to the article in Z. f. Werkstofftechnik/J. of Materials Technology 7, (1976) pages 381 to 389, with the following test conditions:

Sample size: 10 mm×10 mm
Contact surface: spherical R=80 mm
Surface condition: turned
Closing rate: 1 m/second
Contact force: 60 N
Bounce time for the first three changes: 5 ms
Separation rate: $7.4\times10^{-4}$ m/s
Test voltage: 220 V
Make and break current: 1000 A
Number of operations 1000.

The values for the welding force are represented in their cumulative frequency, with the ordinate being graduated according to the Weibull function and the abscissa being graduated logarithmically. Since the mechanical processing may cause high welding force in the first switching processes with AgFeRe contact materials, a 99.8% value is used for comparison with conventionally produced AgFeRe materials.

The following are found:

process according to the invention, Ag (FeRe 95/5) 8.8 material:
welding force: 237 N (99.8%); and conventional process, Ag (FeRe 95/5) 8.8 material with coarse structure:
welding force: 530 N (99.8%).

This result means a 55% better welding behavior for the AgFeRe contact material produced according to the invention as compared to one produced conventionally.

We claim:

1. A process for producing a shaped article from a contact material based on silver, which comprises:

forming a powder mixture from silver and a metal oxide; and processing the powder mixture by powder metallurgy to form a shaped article with the metal oxide completely reduced to metal.

2. The process according to claim 1, which comprises carrying out the step of reducing the metal oxide in the powder mixture.

3. The process according to claim 1, which comprises carrying out the step of reducing the metal oxide in a blank of the shaped article.

4. The process according to claim 1, which comprises carrying out the step of reducing the metal oxide by heat treatment in a reducing atmosphere.

5. The process according to claim 4, which comprises carrying out the heat treatment at a temperature of 500 to 1000° C.

6. The process according to claim 4, which comprises carrying out the heat treatment at a temperature of 700° C.

7. The process according to claim 4, which comprises carrying out the heat treatment in a hydrogen ($H_2$) reducing atmosphere.

8. The process according to claim 1, which comprises selecting a powder with a particle size of less than 1 $\mu$m, as the metal oxide.

9. The process according to claim 1, which comprises selecting a powder with a particle size of between 100 and 500 nm, as the metal oxide.

10. The process according to claim 1, which comprises mixing a material selected from the group consisting of a further metal and a further metal oxide, with the powder mixture.

11. The process according to claim 1, which comprises mixing a material selected from the group consisting of:

silver (Ag), iron oxide ($Fe_2O_3$/$Fe_3O_4$) and rhenium (Re);

silver (Ag), rhenium oxide (ReO) and iron; and silver (Ag), rhenium oxide (ReO) and iron oxide ($Fe_2O_3$/$Fe_3O_4$);

with the powder mixture.

12. In a contact material based on silver, the improvement comprising at least one further metallic component formed of at least one material selected from the group consisting of iron (Fe) and rhenium (Re) and having a mean particle size less than 1 $\mu$m.

13. The contact material according to claim 12, wherein said mean particle size is between 100 and 500 nm.

14. The contact material according to claim 12, wherein said iron (Fe) is present in a proportion by mass of between 1% and 50% and said rhenium (Re) is present in a proportion by mass of between 0.01% and 5%.

15. A shaped article, comprising a contact material based on silver, and at least one further metallic component formed of at least one material selected from the group consisting of iron (Fe) and rhenium (Re) and having a mean particle size less than 1 $\mu$m.

16. The shaped article according to claim 15, wherein said mean particle size is between 100 and 500 nm.

17. The shaped article according to claim 18, wherein said iron (Fe) is present in a proportion by mass of between 1% and 50% and said rhenium (Re) is present in a proportion by mass of between 0.01% and 5%.

18. A contact piece for power engineering switching equipment, in particular for a low-voltage switch, comprising a contact material based on silver, and at least one further metallic component formed of at least one material selected from the group consisting of iron (Fe) and rhenium (Re) and having a mean particle size less than 1 $\mu$m.

* * * * *